US009993686B1

(12) United States Patent
Mills et al.

(10) Patent No.: US 9,993,686 B1
(45) Date of Patent: Jun. 12, 2018

(54) EXERCISE DEVICE

(71) Applicant: MILLZ, Inc., Calabasas, CA (US)

(72) Inventors: Soren Mills, Calabasas, CA (US); Jessica Mills, Calabasas, CA (US); Jonathan Thomas Johnson, Atlanta, GA (US)

(73) Assignee: MILLZ, INC., Calabasas, CA (US)

( * ) Notice: Subject to any disclaimer, the term of this patent is extended or adjusted under 35 U.S.C. 154(b) by 0 days. days.

(21) Appl. No.: 15/590,983

(22) Filed: May 9, 2017

Related U.S. Application Data

(60) Provisional application No. 62/432,255, filed on Dec. 9, 2016.

(51) Int. Cl.
*A63B 22/20* (2006.01)
*A63B 22/16* (2006.01)
*A63C 17/01* (2006.01)

(52) U.S. Cl.
CPC ..... *A63B 22/20* (2013.01); *A63B 22/16* (2013.01); *A63C 17/01* (2013.01)

(58) Field of Classification Search
CPC ..... A63B 22/16; A63B 22/20–22/203; A63C 17/01; A63C 17/014; A63C 17/04
See application file for complete search history.

(56) References Cited

U.S. PATENT DOCUMENTS 1,824,920 A 9/1931 Novak
2,131,570 A 9/1938 Riley
2,973,962 A 3/1961 Griffin
3,403,906 A 10/1968 Burzenski
3,752,475 A 8/1973 Ott
4,136,867 A 1/1979 Wilken
4,177,803 A * 12/1979 Papistas-Scherer ... A61H 15/00 601/28
4,911,440 A * 3/1990 Hyman ..... A63B 22/16 482/146
5,004,229 A 4/1991 Lind
5,669,864 A * 9/1997 Brister ..... A63B 21/0004 482/132
5,707,325 A 1/1998 Chiou
6,017,296 A 1/2000 Tange et al.
(Continued)

OTHER PUBLICATIONS

"Actuator", Merriam-Webster.com, 2017, available at https://www.merriam-webster.com/dictionary/actuator, accessed May 9, 2017.
(Continued)

*Primary Examiner* — Erez Gurari
(74) *Attorney, Agent, or Firm* — Ladas & Parry, LLP

(57) ABSTRACT

An exercise device is described. An exercise device including a body, the body having a top, a bottom, a first end located at one edge of the body, a second end located at an opposite end of the body, and first and second sides extending between the first and second ends; a first axle connected to a first wheel, the first axle also connected to the body proximate the first end at a first hub; a first spring having a first spring end, the first spring positioned at least partially within the first axle, with the first spring end slidably connected to one of the first wheel and the first hub at a first junction, wherein the first junction is configured to convey torque between the one of the first hub and the first wheel and the first spring end.

17 Claims, 7 Drawing Sheets

(56) References Cited

U.S. PATENT DOCUMENTS

| | | | | |
|---|---|---|---|---|
| 6,053,853 | A | 4/2000 | Hinds | |
| 6,348,027 | B1 * | 2/2002 | Lee | A63B 21/0004 482/127 |
| D454,929 | S | 3/2002 | Huang | |
| 6,409,639 | B1 | 6/2002 | Kuo | |
| 6,500,105 | B1 | 12/2002 | Kuo | |
| 6,575,883 | B1 | 6/2003 | Hinds | |
| 6,585,627 | B2 | 7/2003 | Fernandez | |
| 6,761,611 | B2 | 7/2004 | Wood et al. | |
| 7,175,573 | B1 | 2/2007 | Huang | |
| 7,837,603 | B1 | 11/2010 | Carnell | |
| D697,148 | S | 1/2014 | Lin | |
| 8,814,767 | B2 * | 8/2014 | Brodbeck | A63B 22/20 482/132 |
| 9,011,303 | B2 * | 4/2015 | MacColl | A63B 21/0004 482/127 |
| 2002/0025894 | A1 * | 2/2002 | Fernandez | A63B 21/0004 482/140 |
| 2002/0123416 | A1 * | 9/2002 | Huang | A63B 21/153 482/140 |
| 2003/0022770 | A1 | 1/2003 | Lee | |
| 2003/0032536 | A1 | 2/2003 | Mabe et al. | |
| 2003/0134716 | A1 | 7/2003 | Yu | |
| 2003/0158023 | A1 | 8/2003 | Yu | |
| 2010/0304941 | A1 * | 12/2010 | Ota | A63C 5/03 482/146 |
| 2011/0275482 | A1 | 11/2011 | Brodess et al. | |
| 2015/0182792 | A1 | 7/2015 | Maccoll | |
| 2016/0101314 | A1 * | 4/2016 | Exley | A63B 22/20 482/132 |

OTHER PUBLICATIONS

"Clutch", Merriam-Webster.com, 2017, available at https://www.merriam-webster.com/dictionary/clutch, accessed May 9, 2017.

"Wheel", Merriam-Webster.com, 2017, available at https://www.merriam-webster.com/dictionary/wheel, accessed May 9, 2017.

PCT International Search Report and Written Opinion from PCT/US2017/031838 dated Jul. 28, 2017.

* cited by examiner

EXERCISE DEVICE

CROSS REFERENCE TO RELATED APPLICATIONS

This claims the benefit of and priority to U.S. Provisional Patent Appl. No. 62/432,255 entitled "EXERCISE PLATFORM" and filed on Dec. 9, 2016, the disclosure of which is incorporated herein by reference in its entirety.

TECHNICAL FIELD

This disclosure relates to exercise systems and devices including portable exercise devices that provide a resistance force or torque.

BACKGROUND

The present disclosure relates to exercise devices, such as can be used for various exercises to condition or strengthen various muscles, including the core, of a person. Exercise devices such as stationary machines, portable machines and small portable machines can be used for various exercise routines. Some exercise devices can provide a resistive force, such as through the use of springs, rubber bands, weights or gravity. Some exercise devices can be very sophisticated and provide a great deal of flexibility in performing a number of exercises, but be expensive to purchase and complicated to set-up and use.

One important group of muscles to exercise is frequently referred to as the "core." This group of muscles can include muscles of an individual's torso. In various definitions, the core can include one or more of the pelvic floor muscles, transversus abdominis, multifidus, internal and external obliques, rectus abdominis, erector spinae, longissimus thoracis, diaphragm, latissimus dorsi, gluteus maximum, trapezius, and other muscles as well. Having a strong core is believed to contribute to good posture and balance as well as decreasing back and joint pain, muscle fatigue, nerve pain and injury, improve blood circulation, blood pressure, personal energy and positive emotional outlook.

Exercises without exercise equipment can be used to provide general exercise, but exercise equipment can provide additional benefits to an exercise routine, such as to assist in improving form, improve targeting of individual muscles or muscle groups, facilitate a different/greater range of movement during the exercise and vary the resistance during the exercise as compared to exercise without equipment.

One option for individuals that would like to use exercise equipment during a workout would be to join a gym. However, gym memberships can be expensive and frequenting agent can be inconvenient. Purchasing exercise equipment can expensive and the equipment can be bulky. Accordingly, there is a need for compact and inexpensive exercise equipment which can assist in providing an improved exercise experience.

SUMMARY

In a first aspect, an exercise device is provided, the exercise device comprising: a body, the body having a top, a bottom, a first end located at one edge of the body, a second end located at an opposite end of the body, and first and second sides extending between the first and second ends; first and second axles connected to and rotationally locked to first and second wheels, respectively, the first and second wheels able to rotate both in clockwise and counterclockwise directions in relation to the body, the first axle also connected to the body proximate the first end at a first hub and the second axle also connected to the body proximate the second end at a second hub; a first spring with a wheel end and a hub end, the first spring positioned at least partially within the first axle, with the first spring wheel end slidably connected to the first wheel at a first wheel junction, wherein the first wheel junction is configured to convey torque between the first wheel and the first spring wheel end, and the first spring hub end slidably connected to the first hub at a first hub junction, wherein the first hub junction is configured to convey torque between the first hub and the first spring hub end; and a second spring with a wheel end and a hub end, the second spring positioned at least partially within the second axle, with the second spring wheel end slidably connected to the second wheel at a second wheel junction, wherein the second wheel junction is configured to convey torque between the second wheel and the second spring wheel end, and the second spring hub end slidably connected to the second hub at a second hub junction, wherein the second hub junction is configured to convey torque between the second hub and the second spring hub end; when the first and second wheels are rotated against respective first and second spring torques, energy is stored in the first and second springs and the first and second springs apply restoring torque to the first and second wheels, respectively.

In a second aspect, an exercise device is provided, the exercise device comprising: a body, the body having a top, a bottom, a first end located at one edge of the body, a second end located at an opposite end of the body, and first and second sides extending between the first and second ends; a first axle connected to a first wheel, the first axle also connected to the body proximate the first end at a first hub; a first spring having a first spring end, the first spring positioned at least partially within the first axle, with the first spring end slidably connected to one of the first wheel and the first hub at a first junction, wherein the first junction is configured to convey torque between the one of the first hub and the first wheel and the first spring end.

In a third aspect, a method of using an exercise device is provided, the method comprising: moving an exercise device away from a person's waist while the person's feet are placed on a body of the exercise device and the first and second wheels are on a surface, wherein when the exercise device is moved away from the person's waist, the first and second wheels rotate along the surface, and torque energy is stored in the first and second springs; and moving the exercise device toward the person's waist while the person is assisted by or resists torque supplied to the first and second wheels by the first and second springs, respectively, wherein the exercise device comprising: the body, the body having a top, a bottom, a first end located at one edge of the body, a second end located at an opposite end of the body, and first and second sides extending between the first and second ends; first and second axles connected to and rotationally locked to first and second wheels, respectively, the first and second wheels able to rotate both in clockwise and counterclockwise directions in relation to the body, the first axle also connected to the body proximate the first end at a first hub and the second axle also connected to the body proximate the second end at a second hub; a first spring with a wheel end and a hub end, the first spring positioned at least partially within the first axle, with the first spring wheel end slidably connected to the first wheel at a first wheel junction, wherein the first wheel junction is configured to convey torque between the first wheel and the first spring wheel end, and the first spring hub end slidably connected to the first hub at a first hub junction, wherein the first hub junction is configured to convey torque between the first hub and the first spring hub end; and a second spring with a wheel end and a hub end, the second spring positioned at least partially within the second axle, with the second spring wheel end slidably connected to the second wheel at a second wheel junction, wherein the second wheel junction is configured to convey torque between the second wheel and the second spring wheel end, and the second spring hub end slidably connected to the second hub at a second hub junction, wherein the second hub junction is configured to convey torque between the second hub and the second spring hub end; when the first and second wheels are rotated against respective first and second spring torques, energy is stored in the first and second springs and the first and second springs apply restoring torque to the first and second wheels, respectively.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 1:
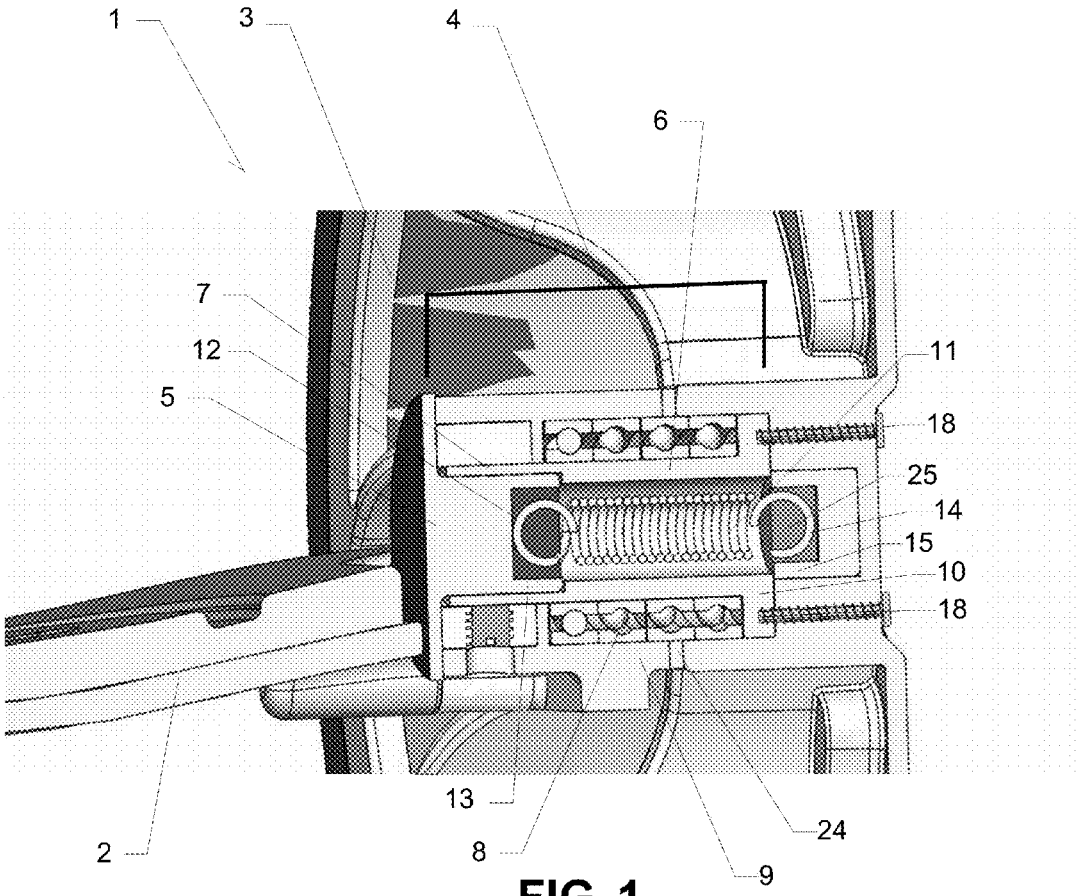
FIG. 1 shows an embodiment of an end of an exercise device.
Figure 2:
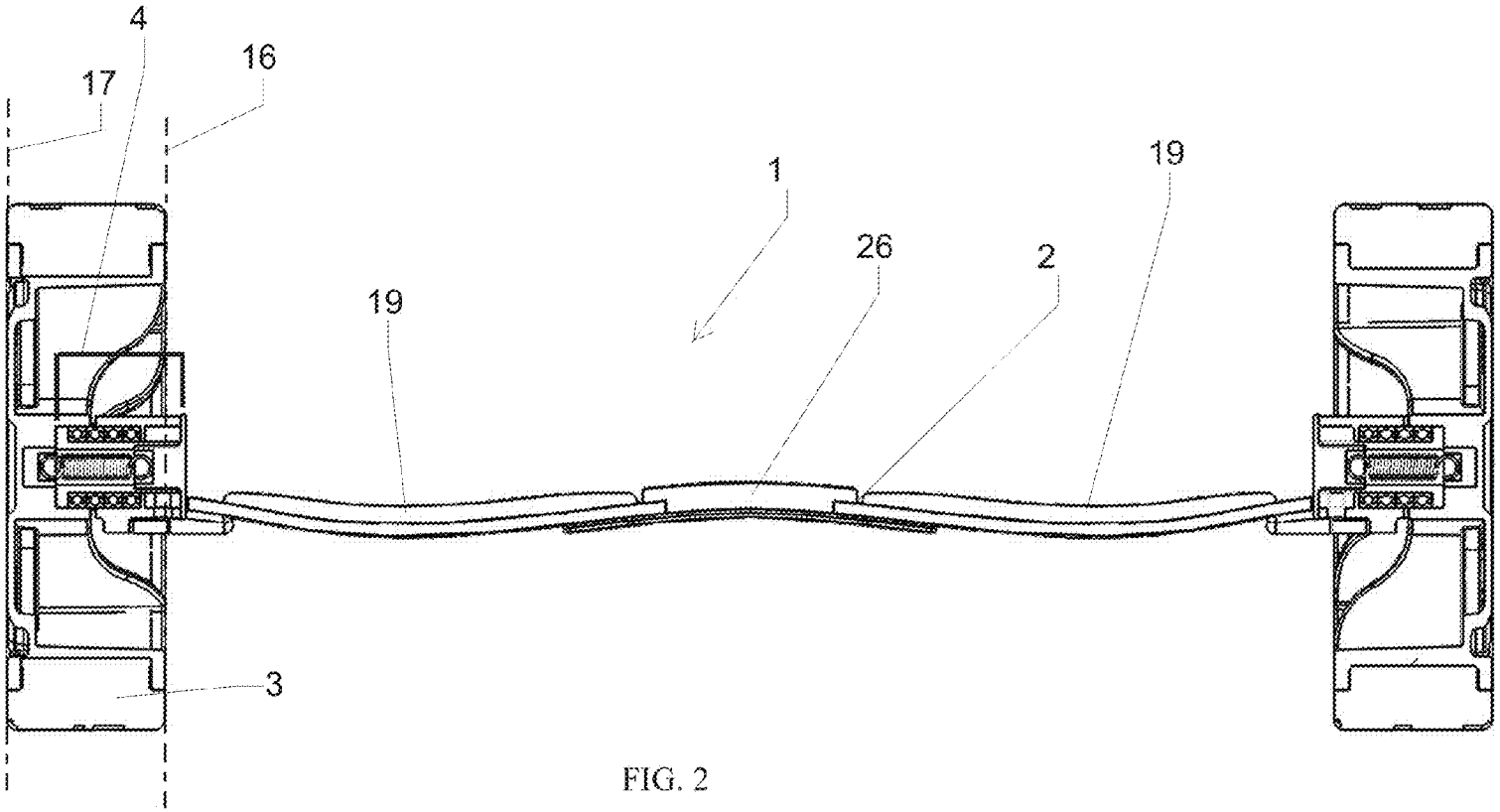
FIG. 2 shows an embodiment of an exercise device having two wheels.

In an embodiment of an exercise device 1, an exercise device can include a body 2 connected to a wheel 3 through a hub assembly 4 where the hub assembly is able to store torsional energy. In some embodiments, such as is shown in FIG. 1, the wheel 3 and hub assembly 4 can be proximate a first end of the body 2. In some embodiments, such as is shown in FIG. 2, an exercise device can include first and second wheels 3 attached to body 2 through respective first and second hub assemblies 4. In some embodiments, the first and second wheels and first and second hub assemblies 2 can be located proximate opposite ends of body 2, as shown in FIG. 2.

The hub assembly 4 can comprise a hub 5, axle 6 and spring 11. In one embodiment, as shown in FIG. 1, the hub 5 can be connected to an axle 6 at a hub end 7 of the axle 6, with the axle 6 extending outward from the hub 5. External to the axle 6 are one or more bearings 8 in contact with the axle 6 and providing a rotating connection between the axle 6 and the housing 9. Bearings 8 can be of any suitable type, such as ball, sleeve, bushing, roller, etc. The axle 6 connected to a wheel 3 at the wheel end 10 of the axle 6. Within axle 6 is located spring 11. Spring 11 has a hub end 12 ("spring hub end") connected to the hub junction 13 located on the hub 5, and a wheel end 14 ("spring wheel end") of spring 11 connected to the wheel junction 15 located on the wheel 3.

In some embodiments, one or both of the hub junction 13 and the wheel junction 15 are connected to their respective ends of spring 11 by way of sliding connections, such that wheel end 14 of spring 11 is slidably received into wheel junction 15 and/or hub end 12 of spring 11 is slidably received into hub junction 13. In some embodiments, a hub junction 13 can be configured to transfer torque between the hub junction 13 and the spring 11. In some embodiments, the wheel junction 15 can be configured to transfer torque between the wheel junction 15 and the spring 11. In some embodiments, both the wheel junction 15 and the hub junction 13 can be configured to transfer torque between the spring 11 and the wheel junction 15 and the hub junction 13.

Junctions

Figure 3:
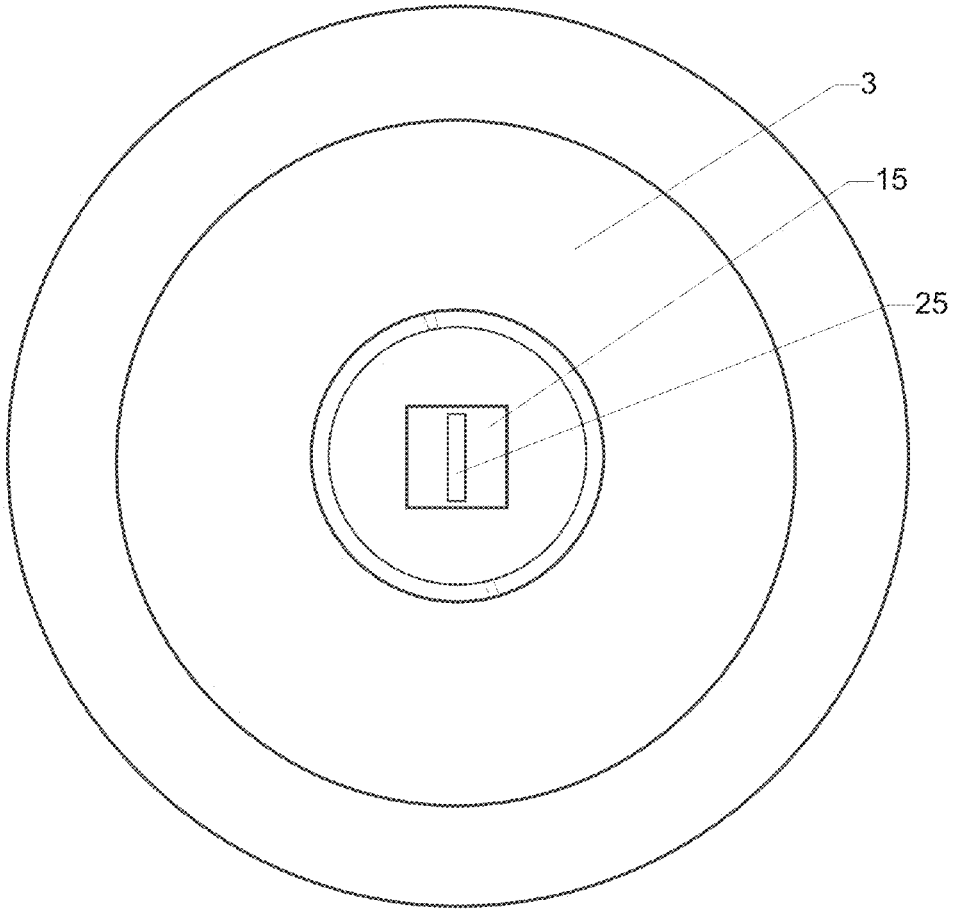
FIG. 3 shows an embodiment of a wheel junction.
Figure 4:
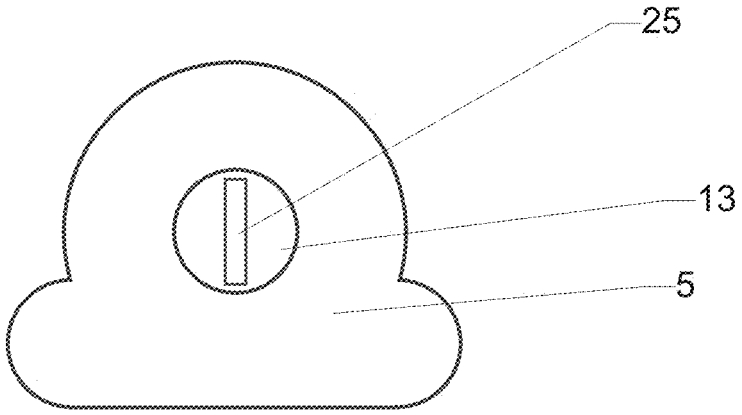
FIG. 4 shows an embodiment of a hub junction.

Junctions, such as wheel junctions and hub junctions are configured to transfer torque between the junction and the spring. In some embodiments, a junction can comprise a relief opening, such as a slot, which receives an end of the spring, such as a hub end or a spring end. FIG. 3 shows an embodiment of a wheel junction having a slot and FIG. 4 shows an embodiment of a hub junction having a slot. The spring end can include one or more extensions extending from the spring, such as a loop, a tab, a pin or another shape or a series of loops, tabs, pins, other shapes and combinations thereof which when inserted into the relief opening can interact with the interior surfaces of the relief opening to transfer forces therebetween such as in the form of a couple. In some embodiments, the relief opening can extend entirely across the face of the junction so as to have open ends at each edge of the junction. In some embodiments, the relief opening can extend across only a portion of the junction so as to have no open ends or only one open end at an edge of the junction.

In some embodiments, the relief opening can comprise two parallel faces extending into the face of the junction. In some embodiments, one or more faces of the relief opening can be curves. In some embodiments, the relief opening can have faces which are planar. In some embodiments, the junction can comprise more than one relief opening, such as where two or more relief opening cross one another or where two or more relief opening do not intersect with one another. In some embodiments, the relief opening can have a shape where the length is substantially the same as the width, such as in the shape of a square, or where the length is longer than the width, such as in the shape of a rectangle. In some embodiments, the relief opening can be in the shape of a triangle or other geometric shape where a spring end would be able to interact with wall to transfer torque. In some embodiments, the relief opening can comprise multiple openings, such as two or more holes and the spring end can comprise extensions which fit into two or more holes so as to transfer torque. In some embodiments, the two or more holes can be in the shape of circles, squares, triangles, ovals or other suitable shape, with one hole having the same or different shape from the other.

In some embodiments, the junction can have one or more extensions, as described above for spring end, and the spring end can include a relief opening as described above for the junctions, where the one or more extensions are slidably received into the relief openings and transfer torque.

In some embodiments, a wheel junction can be a part of the wheel or the wheel junction can be a separate part attached to the wheel. FIG. 3 shows an embodiment of a replaceable wheel junction having a square shape, however different shapes can be used. In some embodiments, the replaceable wheel junction can be made to have different sizes/shapes/configurations/number of holes or slots for use with different spring ends. In some embodiments, a replaceable wheel junction can be dropped into a receptacle in the wheel or it can be a friction fit into a receptacle in the wheel or it can be attached to the wheel by other means as would be understood by those of skill in the art.

In some embodiments, the hub junction can be a part of the hub or the hub junction can be a separate part attached to the hub. In some embodiments, the hub junction can be replaceable having features as discussed for a replaceable wheel junction.

Spring Tension/Movement of the Exercise Device

In some embodiments, as the wheel turns in relation to the body, torsional energy will be stored in the spring 11. Rotating the wheel further results in greater energy being stored in the spring 11.

When the exercise device is placed on a surface and moved in a first direction, the wheel 3 will turn and energy can be stored in the spring 11. The further the exercise device is moved, such as by pushing the exercise device with the wheel(s) turning as the exercise device moves across a surface, more energy can be stored in spring 11. As energy is stored in the spring, a countering force can be present which resists further movement of the exercise device in the first direction. If the pushing force is decreased to below that of the countering force, the exercise device will move backwards counter to the first direction. In some embodiments, the exercise device can also be moved in a second direction, opposite to the first directions and the spring will store energy and apply a countering force in an opposite direction to when the exercise device is moved in the first direction.

Spring

Figure 5:
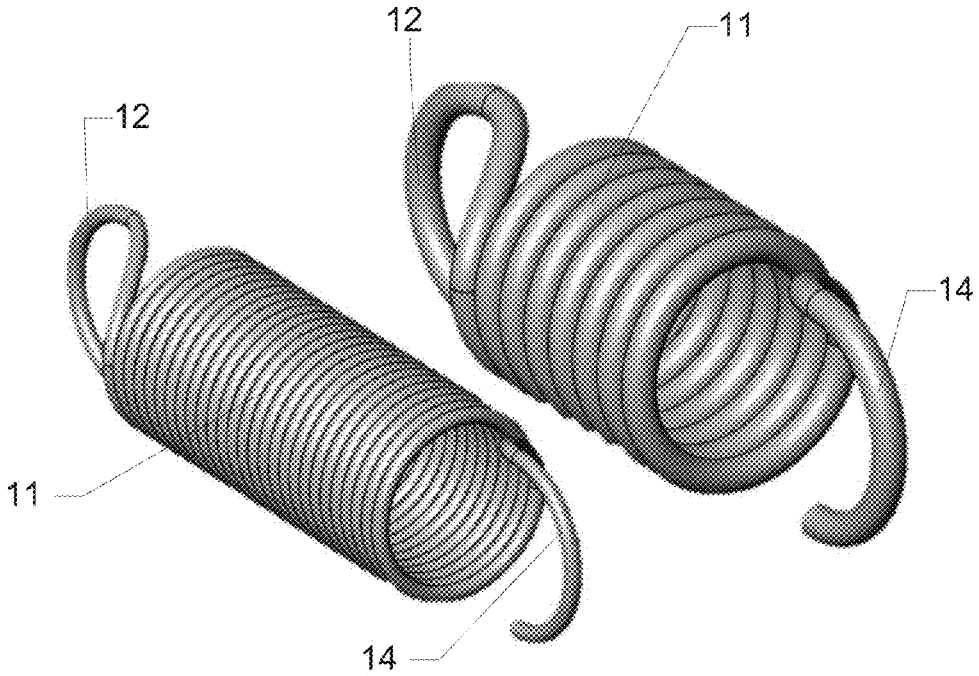
FIG. 5 shows an embodiment of a spring.

In various embodiments, the spring 11 can be a material which is capable of storing torsional energy. In some embodiments, the spring 11 can be a coil spring, such as is shown in FIG. 5. In various embodiments of a coil spring, the coil spring can have different numbers of loops, the loops can be space close to one another, such as would be associated with a coil spring that is tightly wound, or the loops can be spaced further apart, such as would be associated with a coil spring that is more loosely wound. In various embodiments, the spring material can be thicker or thinner and of a suitable material so as to provide desirable spring force characteristics and energy storage.

In some embodiments, the spring 11 can have a different shape, such as being in the form of a rod, a sheet or multiple rods, or sheets or combinations thereof.

Spring material can be or comprise any suitable metal, such as steel, stainless steel, steel alloy, bronze, phosphor bronze, titanium, beryllium copper, or other metals and combinations thereof. Spring materials can also be or comprise polymer or elastomers.

In some embodiments, the spring 11 can be installed entirely within the axle 6. In some embodiments, the spring 11 can be located partially within and partially without the axle 6. In some embodiments, the spring 11 can be located such that at least a portion of one or both of the spring ends extend from the axle 6. In some embodiments, the spring 11 can be located entirely within the wheel 3 where the spring 11 does not extend past the inner plane 16 and the outer plane 17 of the wheel 3. In some embodiments, the spring 11 can be located only partially within the wheel 3, where the spring 11 extends only partially outside of the inner plane 16 and/or the outer plane 17 of the wheel 3. In some embodiments, the spring 11 can be located outside of the wheel 3 where the spring 11 is located entirely outside of the inner plane 16 and the outer plane 17 of the wheel 3.

In some embodiments, the spring 11 can be sized such that the clearance between the spring and the axle prevents kinking of the spring when the spring is overwound.

In some embodiments, the spring 11 is sized such that the clearance between the spring and the axle and/or the overall length of the spring 11 relieves stress from the spring by allowing the hub and wheel ends of the spring 11 to move toward one another during an overwound condition, resulting in one of the hub and wheel ends of the spring 11 slipping out of the respective junction.

In some embodiments, such as shown in FIG. 1, the spring 11 can be can be installed or replaced, for example, by removing a spring by removing the screws 18 which attach wheel 3 to the axle 6, removing the wheel 3, and then pulling out the spring 11 from the interior of axle 6; then installing a spring by placing the spring 11 into the interior of axle 6 so as the hub end of the spring 11 aligns with and is slidably received into the hub junction such as into a slot in the hub junction; and then installing the wheel 3 by aligning the wheel junction with the wheel end of the spring 11, slidably receiving the wheel end of the spring 11 into the wheel junction, and installing screws 18 to attach the wheel 3 to axle 6.

Wheels

In some embodiments, the wheel can be rotationally affixed to the axle. In one embodiment, as shown in FIG. 1, screws 18 attach wheel 3 to axle 6. However other types of fastening can also be used, such as bolts, clips, pins, nuts and the like.

In some embodiments, a body 2 can be attached to one wheel through a hub assembly 4 which can store torsional energy, as described herein. In some embodiments, a body 2 can be attached to two wheels 18 through respective hub assemblies 2, each of which can store torsional energy as described herein. In some embodiments, a body 2 can be attached to a first wheel 3 through a hub assembly 4 which can store torsional energy as described herein and to a second wheel through other than a hub assembly 4 which can store torsional energy as described herein. In some embodiments, the exercise device 1 includes only one wheel and the wheel is connected to the body 2 through a hub assembly 4 which can store torsional energy as described herein. In one embodiment, the exercise device includes exactly two wheels 18 and both of the two wheels are connected to the body 2 through respective hub assemblies 2 which can store torsional energy as described herein.

In some embodiments, an exercise device 1 can have more than two wheels, such as four wheels. In some embodiments having more than two wheels, one or more or all of the wheels can be attached to the body 2 through respective hub assemblies 2 which can store torsional energy as described herein. In some embodiments with four wheels, one, two, three or four wheels can be attached to the body 2 through respective hub assemblies 2 which can store torsional energy as described herein.

When a wheel 3 is attached to body 2 other than through a hub assembly 4 that can store torsional energy as described herein, the wheel 3 can be attached by any suitable means such as through a fixed axle, a rotating axle, or otherwise as would be known to one of skill in the art.

In some embodiments, wheels of different sizes and with different surface contacting features (e.g. tread) can be used for example to accommodate different exercises, different sizes of user, different surfaces for the exercise device to move along, and the like.

Body

In some embodiments, a body can extend between two wheels. The body can be sized and configured for an individual using the exercise device to be able to place any portion of a user's anatomy that is desired and in the orientation desired. In some embodiments, the body 2 can be sized and configured for one or two feet, hands, knees, forearms or etc. on the body to use the exercise device. In some embodiments, one or two feet/hands/knees/forearms/etc. can be oriented with the feet/hands/knees/forearms oriented with the direction of movement of the body. In some embodiments, the feet/hands/knees/forearms/etc. can be oriented sideways (e.g. with toe and heel pointing at the wheels 3) or at an angle to the direction of movement of the body 2. In some embodiments, the body can be sized and configured for an individual using the exercise device to be able to place only one foot, hand, knee, forearm or etc. on the body to use the exercise device. In some embodiments, the body 2 can be sized and configured for a user's back or bottom to contact the body 2 during exercise.

Figure 6:
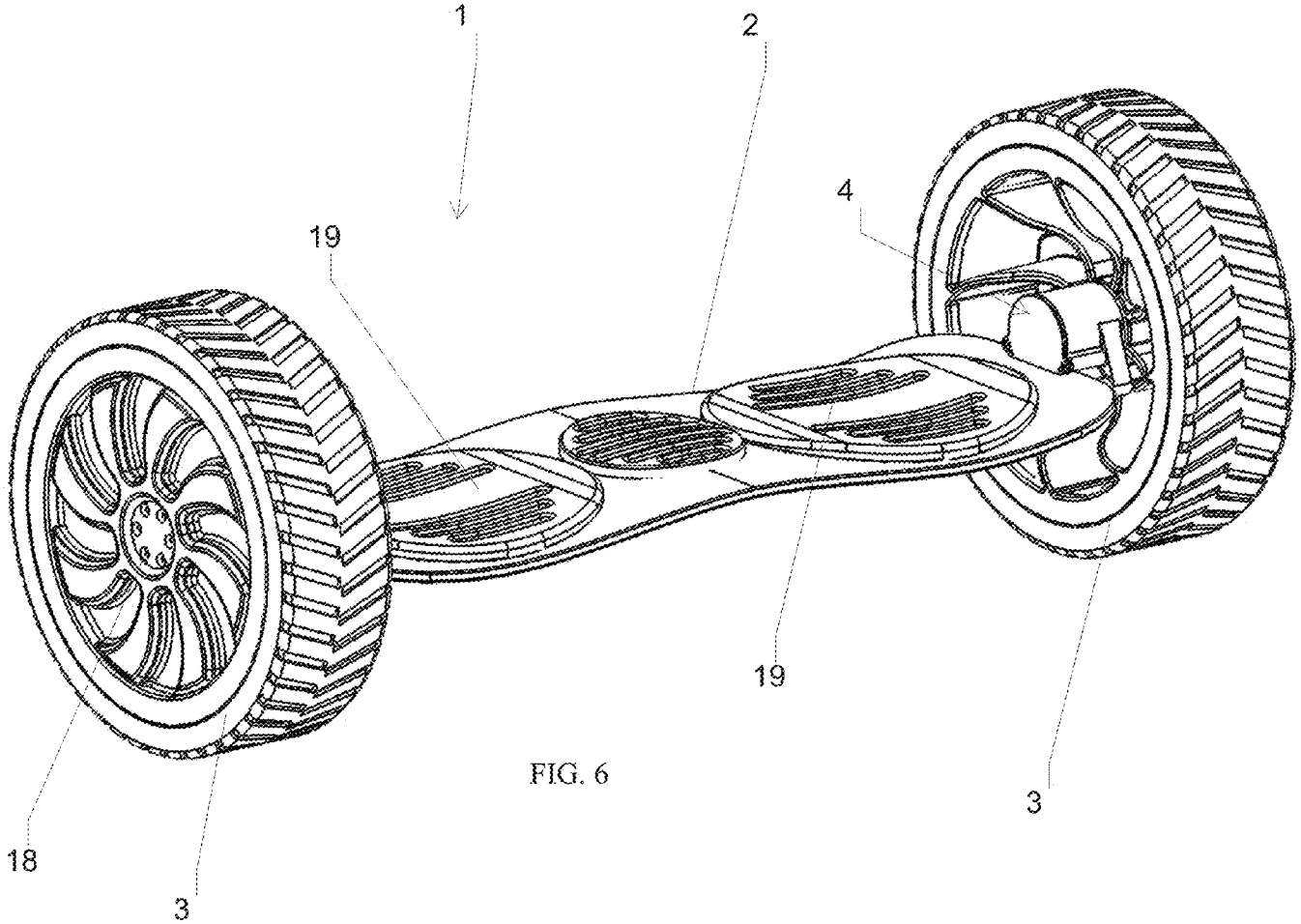
FIG. 6 shown an embodiment of an exercise device.

In some embodiments, the body can include recess(es) or bump(s) or combinations thereof on a surface of the body to interface with feet or hands or forearms or other portions of a user's anatomy and assist in placement of the feet/hands/knees/forearms/etc. at an appropriate location on the body. FIG. 6 shows an embodiment of an exercise device 1 having recesses 19 in the body 2. In some embodiments, the recesses or bumps can be achieved by curving the body 2.

In some embodiments, one or more straps can be positioned on the body to be grasped by an individual while using the exercise device 1 or for the user to place hands/feet/forearms between the strap and the body while using the exercise device 1. (See FIG. 7.)

In some embodiments, padding can be provided on the body.

Secondary Platform

Figure 7:
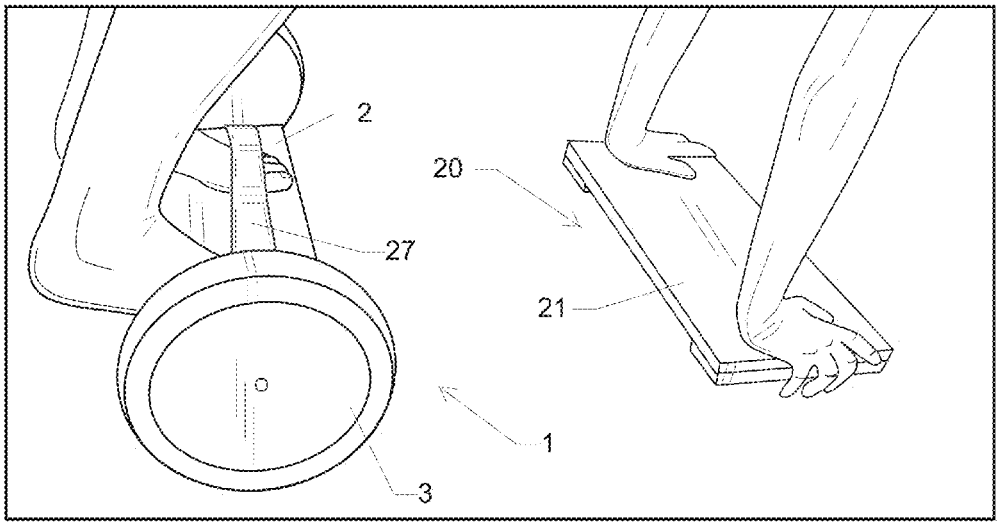
FIG. 7 shows an embodiment of an exercise device having a strap.

In some embodiments, the exercise device can be used with a secondary platform 20 comprising a surface 21 raised off the ground as shown in FIG. 7. In general, the secondary platform 20 can be sized and configures to support one portion of a user's anatomy while the exercise device 1 supports and is moved by another portion of a user's anatomy. In some embodiments, the secondary platform can be sized and configured for placing one's feet thereon while one uses the exercise device with one's hands on the exercise device. In some embodiments, the secondary platform can be sized and configured for placing one's hand(s) on the secondary platform or to grasp the edge(s) of the secondary platform while one uses the exercise device with one's foot/feet on the exercise device. In some embodiments, the secondary platform can be sized and configured to support one foot of a user while the exercise device 1 supports the other foot of the user. In some embodiments, the secondary platform can be used to support one or both feet of a user while the exercise device support one or both hands of a user.

Operation of the Exercise Device

Generally, the exercise device operates by the spring(s) 11 providing a resisting force against rotation of the wheel(s) while the spring(s) 11 store torsional energy during rotation of the wheel(s) 3, and then releasing this stored energy while providing a restoring force during rotation of the wheel(s) 3 in the opposite direction. In various embodiments, the restoring force can be a force that assists the user in the movement of the exercise device 1 or the restoring force can be a force that the user resists during movement of the exercise device 1.

Exercise device 1 can be employed in exercises by a user in many ways. One exemplary embodiment involves the user placing his/her hands on the body 2 with the wheels 18 resting on a surface, the user placing his/her feet on the surface with the user's body bent at the waist, and the user pushing the exercise device 1 away from the feet against spring force in the exercise device 1 and at least partially straightening the user's body. With this movement, the exercise device is moved against a resisting force provided by the spring(s) 11 while torsional energy will be stored in the spring(s) 11 of the exercise device 1. The user can then move exercise device back toward the starting position and toward the user's feet with the spring(s) 11 of the exercise device 1 providing a restoring force which can assist the user in the movement back toward the starting position while releasing energy stored in spring(s) 11. In a variation on this embodiment of a use, the user can place his/her hands on the surface and his/her feet on the body. In further variations on these embodiments, the starting position can be with a more straightened body, and the motion that stores torsional energy into spring 11 can be a movement that bends the body, for example, at the waist.

In another embodiment of an exercise with the exercise device, a user can place one foot on the exercise device and his/her other foot on the surface the exercise device is on or on a secondary platform that is placed on the surface the exercise device is on, and the feet are moved alternately away from and toward each other, with the spring(s) 11 alternately storing torsional energy while providing a resisting force and releasing energy while providing a restoring force.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . "

Concepts

Concept 1. An exercise device comprising:

a body, the body having a top, a bottom, a first end located at one edge of the body, a second end located at an opposite end of the body, and first and second sides extending between the first and second ends;

first and second axles connected to and rotationally locked to first and second wheels, respectively, the first and second wheels able to rotate both in clockwise and counterclockwise directions in relation to the body, the first axle also connected to the body proximate the first end at a first hub and the second axle also connected to the body proximate the second end at a second hub;

a first spring with a wheel end and a hub end, the first spring positioned at least partially within the first axle, with the first spring wheel end slidably connected to the first wheel at a first wheel junction, wherein the first wheel junction is configured to convey torque between the first wheel and the first spring wheel end, and the first spring hub end slidably connected to the first hub at a first hub junction, wherein the first hub junction is configured to convey torque between the first hub and the first spring hub end; and a second spring with a wheel end and a hub end, the second spring positioned at least partially within the second axle, with the second spring wheel end slidably connected to the second wheel at a second wheel junction, wherein the second wheel junction is configured to convey torque between the second wheel and the second spring wheel end, and the second spring hub end slidably connected to the second hub at a second hub junction, wherein the second hub junction is configured to convey torque between the second hub and the second spring hub end;

when the first and second wheels are rotated against respective first and second spring torques, energy is stored in the first and second springs and the first and second springs apply restoring torque to the first and second wheels, respectively.

Concept 2. An exercise device comprising:

a body, the body having a top, a bottom, a first end located at one edge of the body, a second end located at an opposite end of the body, and first and second sides extending between the first and second ends;

a first axle connected to a first wheel, the first axle also connected to the body proximate the first end at a first hub;

a first spring having a first spring end, the first spring positioned at least partially within the first axle, with the first spring end slidably connected to one of the first wheel and the first hub at a first junction, wherein the first junction is configured to convey torque between the one of the first hub and the first wheel and the first spring end.

Concept 3. The exercise device of Concept 2, wherein the first spring comprises a second spring end opposite the first spring end, and the first spring end is slidably connected to one of the first hub and first wheel and the second spring end is slidably connected to the other of the first hub and first wheel at a second junction, wherein the second junction is configured to transfer torque between the other of the first hub and the first wheel and the second spring end.

Concept 4. The exercise device of Concept 2, wherein the first junction is a slot configured to receive the first spring end.

Concept 5. The exercise device of Concept 3, wherein the second junction is a slot configured to receive the second spring end.

Concept 6. The exercise device of Concept 2, wherein the first axle is rotationally locked to the first wheel.

Concept 7. The exercise device of Concept 2, wherein the first spring is contained entirely within the first axle.

Concept 8. The exercise device of Concept 2, wherein the body is sized and configured for two feet to be placed upon the body and for the feet to push the body; and the first wheel has a neutral position wherein the first spring does not apply torque to the first wheel, and when the first wheel is rotated away from the neutral position, energy is stored in the first spring and the first spring applies a restoring torque to the first wheel.

Concept 9. The exercise device of Concept 3, wherein the wheel comprises a spring cover and the junction or the second junction is located in the spring cover.

Concept 10. The exercise device of Concept 2, further comprising:

a second wheel, a second axle and a second spring;

wherein the second axle is connected to the second wheel, the second axle is also connected to the body proximate the second end of the body at a second hub;

the second spring having a first spring end, the second spring positioned at least partially within the second axle, with the first spring end of the second spring slidably connected to one of the second wheel and the second hub at a third junction, wherein the third junction is configured to convey torque between the one of the second hub and the second wheel and the first spring end of the second spring.

Concept 11. The exercise device of Concept 10, wherein:

the second spring further comprises a second spring end opposite the first spring end of the second spring; and the second spring end of the second spring is slidably connected to the other of the second wheel and the second hub at a fourth junction, wherein the fourth junction is configured to convey torque between the other of the second hub and the second wheel and the second spring end.

Concept 12. The exercise device of Concept 2, wherein the first spring is located above the body when the body top is facing up.

Concept 13. The exercise device of Concept 2, wherein the first spring is located below the body when the body top is facing up.

Concept 14. The exercise device of Concept 2, wherein the first spring is located at least partially within the first wheel.

Concept 15. The exercise device of Concept 2, wherein the first spring is located entirely within the first wheel.

Concept 16. The exercise device of Concept 2, wherein the first spring is a coil spring.

Concept 17. A method of using the exercise device of Concept 1 comprising:

moving the exercise device away from a person's waist while the person's feet are placed on the body of the exercise device and the first and second wheels are on a surface, wherein when the exercise device is moved away from the person's waist, the first and second wheels rotate along the surface, and torque energy is stored in the first and second springs; and moving the exercise device toward the person's waist while the person is assisted by or resists torque supplied to the first and second wheels by the first and second springs, respectively.

Concept 18. An exercise device comprising:

a body, the body having a top, a bottom, a first end located at one edge of the body, a second end located at an opposite end of the body, and first and second sides extending between the first and second ends;

first and second axles connected to and rotationally locked to first and second wheels, respectively, the first and second wheels able to rotate both in clockwise and counterclockwise directions in relation to the body, the first axle also connected to the body proximate the first end at a first hub and the second axle also connected to the body proximate the second end at a second hub;

a first spring with a wheel end and a hub end, the first spring positioned at least partially within the first axle, with the first spring wheel end slidably connected to the first wheel at a first wheel junction, wherein the first wheel junction is configured to convey torque between the first wheel and the first spring wheel end, and the first spring hub end slidably connected to the first hub at a first hub junction, wherein the first hub junction is configured to convey torque between the first hub and the first spring hub end; and a second spring with a wheel end and a hub end, the second spring positioned at least partially within the second axle, with the second spring wheel end slidably connected to the second wheel at a second wheel junction, wherein the second wheel junction is configured to convey torque between the second wheel and the second spring wheel end, and the second spring hub end slidably connected to the second hub at a second hub junction, wherein the second hub junction is configured to convey torque between the second hub and the second spring hub end;

when the first and second wheels are rotated against respective first and second spring torques, energy is stored in the first and second springs and the first and second springs apply restoring torque to the first and second wheels, respectively.

Concept 19. An exercise device comprising:

a body, the body having a top, a bottom, a first end located at one edge of the body, a second end located at an opposite end of the body, and first and second sides extending between the first and second ends;

a first axle connected to a first wheel, the first axle also connected to the body proximate the first end at a first hub;

a first spring having a first spring end, the first spring positioned at least partially within the first axle, with the first spring end slidably connected to one of the first wheel and the first hub at a first junction, wherein the first junction is configured to convey torque between the one of the first hub and the first wheel and the first spring end.

Concept 20. The exercise device of Concept 19, wherein the first spring comprises a second spring end opposite the first spring end, and the first spring end is slidably connected to one of the first hub and first wheel and the second spring end is slidably connected to the other of the first hub and first wheel at a second junction, wherein the second junction is configured to transfer torque between the other of the first hub and the first wheel and the second spring end.

Concept 21. The exercise device of Concept 19 or 20, wherein the first junction is a slot configured to receive the first spring end.

Concept 22. The exercise device of any one of Concepts 20-21, wherein the second junction is a slot configured to receive the second spring end.

Concept 23. The exercise device of any one of Concepts 19-22, wherein the first axle is rotationally locked to the first wheel.

Concept 24. The exercise device of any one of Concepts 19-23, wherein the first spring is contained entirely within the first axle.

Concept 25. The exercise device of any one of Concepts 19-24, wherein the body is sized and configured for two feet to be placed upon the body and for the feet to push the body; and the first wheel has a neutral position wherein the first spring does not apply torque to the first wheel, and when the first wheel is rotated away from the neutral position, energy is stored in the first spring and the first spring applies a restoring torque to the first wheel.

Concept 26. The exercise device of Concept 19 or 20, wherein the first wheel comprises a spring cover and the first junction or the second junction is located in the spring cover.

Concept 27. The exercise device of any one of Concepts 19-26, wherein the first spring is located above the body when the body top is facing up.

Concept 28. The exercise device of any one of Concepts 19-27, wherein the first spring is located below the body when the body top is facing up.

Concept 29. The exercise device of any one of Concepts 19-28, wherein the first spring is located at least partially within the first wheel.

Concept 30. The exercise device of any one of Concepts 19-29, wherein the first spring is located entirely within the first wheel.

Concept 31. The exercise device of any one of Concepts 19-30, wherein the first spring is a coil spring.

Concept 32. The exercise device of any one of Concepts 19-31-14, further comprising:

a second wheel, a second axle and a second spring;

wherein the second axle is connected to the second wheel, the second axle is also connected to the body proximate the second end of the body at a second hub;

the second spring having a first spring end, the second spring positioned at least partially within the second axle, with the first spring end of the second spring slidably connected to one of the second wheel and the second hub at a third junction, wherein the third junction is configured to convey torque between the one of the second hub and the second wheel and the first spring end of the second spring.

Concept 33. The exercise device of Concept 32, wherein:

the second spring further comprises a second spring end opposite the first spring end of the second spring; and the second spring end of the second spring is slidably connected to the other of the second wheel and the second hub at a fourth junction, wherein the fourth junction is configured to convey torque between the other of the second hub and the second wheel and the second spring end.

Concept 34. A method of using the exercise device of Concept 18 comprising:

moving the exercise device away from a person's waist while the person's feet are placed on the body of the exercise device and the first and second wheels are on a surface, wherein when the exercise device is moved away from the person's waist, the first and second wheels rotate along the surface, and torque energy is stored in the first and second springs; and moving the exercise device toward the person's waist while the person is assisted by or resists torque supplied to the first and second wheels by the first and second springs, respectively.

We claim:

1. An exercise device comprising:

a body, the body having a top, a bottom, a first end located at one edge of the body, a second end located at an opposite end of the body, and first and second sides extending between the first and second ends;

first and second axles connected to and rotationally locked to first and second wheels, respectively, the first and second wheels able to rotate both in clockwise and counterclockwise directions in relation to the body, the first axle also connected to the body proximate the first end at a first hub and the second axle also connected to the body proximate the second end at a second hub;

a first spring with a wheel end and a hub end, the first spring positioned at least partially within the first axle, with the first spring wheel end slidably connected to the first wheel at a first wheel junction, wherein the first wheel junction is configured to convey torque between the first wheel and the first spring wheel end, and the first spring hub end slidably connected to the first hub at a first hub junction, wherein the first hub junction is configured to convey torque between the first hub and the first spring hub end; and a second spring with a wheel end and a hub end, the second spring positioned at least partially within the second axle, with the second spring wheel end slidably connected to the second wheel at a second wheel junction, wherein the second wheel junction is configured to convey torque between the second wheel and the second spring wheel end, and the second spring hub end slidably connected to the second hub at a second hub junction, wherein the second hub junction is configured to convey torque between the second hub and the second spring hub end;

when the first and second wheels are rotated against respective first and second spring torques, energy is stored in the first and second springs and the first and second springs apply restoring torque to the first and second wheels, respectively.

2. An exercise device comprising:

a body, the body having a top, a bottom, a first end located at one edge of the body, a second end located at an opposite end of the body, and first and second sides extending between the first and second ends;

a first axle connected to a first wheel, the first axle also connected to the body proximate the first end at a first hub;

a first spring having a first spring end, the first spring positioned at least partially within the first axle, with the first spring end slidably connected to one of the first wheel and the first hub at a first junction, wherein the first junction is configured to convey torque between the one of the first hub and the first wheel and the first spring end.

3. The exercise device of claim 2, wherein the first spring comprises a second spring end opposite the first spring end, and the first spring end is slidably connected to one of the first hub and first wheel and the second spring end is slidably connected to the other of the first hub and first wheel at a second junction, wherein the second junction is configured to transfer torque between the other of the first hub and the first wheel and the second spring end.

4. The exercise device of claim 2, wherein the first junction is a slot configured to receive the first spring end.

5. The exercise device of claim 3, wherein the second junction is a slot configured to receive the second spring end.

6. The exercise device of claim 2, wherein the first axle is rotationally locked to the first wheel.

7. The exercise device of claim 2, wherein the first spring is contained entirely within the first axle.

8. The exercise device of claim 2, wherein the body is sized and configured for two feet to be placed upon the body and for the feet to push the body; and the first wheel has a neutral position wherein the first spring does not apply torque to the first wheel, and when the first wheel is rotated away from the neutral position, energy is stored in the first spring and the first spring applies a restoring torque to the first wheel.

9. The exercise device of claim 3, wherein the wheel comprises a spring cover and the first junction or the second junction is located in the spring cover.

10. The exercise device of claim 2, further comprising:

a second wheel, a second axle and a second spring;

wherein the second axle is connected to the second wheel, the second axle is also connected to the body proximate the second end of the body at a second hub;

the second spring having a first spring end, the second spring positioned at least partially within the second axle, with the first spring end of the second spring slidably connected to one of the second wheel and the second hub at a third junction, wherein the third junction is configured to convey torque between the one of the second hub and the second wheel and the first spring end of the second spring.

11. The exercise device of claim 10, wherein:

second spring further comprises a second spring end opposite the first spring end of the second spring; and of the second spring is slidably connected to the other of second wheel and second hub at a fourth junction, wherein the fourth junction is configured to convey torque between the other of second hub and second wheel and the second spring end.

12. The exercise device of claim 2, wherein the first spring is located above the body when the body top is facing up.

13. The exercise device of claim 2, wherein the first spring is located below the body when the body top is facing up.

14. The exercise device of claim 2, wherein the first spring is located at least partially within the first wheel.

15. The exercise device of claim 2, wherein the first spring is located entirely within the first wheel.

16. The exercise device of claim 2, wherein the first spring is a coil spring.

17. A method of using the exercise device of claim 1 comprising:

moving the exercise device away from a person's waist while the person's feet are placed on the body of the exercise device and the first and second wheels are on a surface, wherein when the exercise device is moved away from the person's waist, the first and second wheels rotate along the surface, and torque energy is stored in the first and second springs; and moving the exercise device toward the person's waist while the person is assisted by or resists torque supplied to the first and second wheels by the first and second springs, respectively.

* * * * *